US011319966B2

(12) United States Patent
Malvasi

(10) Patent No.: US 11,319,966 B2
(45) Date of Patent: May 3, 2022

(54) MOTOR VEHICLE AUXILIARY POWER UNIT VACUUM PUMP

(71) Applicant: PIERBURG PUMP TECHNOLOGY GMBH, Neuss (DE)

(72) Inventor: Alessandro Malvasi, Leghorn (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 532 days.

(21) Appl. No.: 16/324,912

(22) PCT Filed: Aug. 15, 2016

(86) PCT No.: PCT/EP2016/069326

§ 371 (c)(1),
(2) Date: Feb. 12, 2019

(87) PCT Pub. No.: WO2018/033194

PCT Pub. Date: Feb. 22, 2018

(65) Prior Publication Data

US 2021/0285406 A1 Sep. 16, 2021

(51) Int. Cl.
*F04D 29/053* (2006.01)
*F04D 25/06* (2006.01)
(Continued)

(52) U.S. Cl.
CPC ..... *F04D 29/053* (2013.01); *F04D 25/062* (2013.01); *F04D 25/0693* (2013.01); *F04D 29/023* (2013.01); *F02D 41/0032* (2013.01); *F02M 25/089* (2013.01); *F02M 37/20* (2013.01); *F04D 7/02* (2013.01); *F04D 9/001* (2013.01); *F04D 13/0633* (2013.01); *F04D 15/0077* (2013.01); *F04D 25/0606* (2013.01)

(58) Field of Classification Search
CPC ..... F02M 25/08; F02M 37/20; F02M 25/089; F02M 25/0818; F04D 25/062;
(Continued)

(56) References Cited

U.S. PATENT DOCUMENTS 5,313,129 A * 5/1994 Stewart ..... H02K 5/1672 310/71
6,014,958 A 1/2000 Miwa et al.
(Continued)

FOREIGN PATENT DOCUMENTS

CN 1412429 A 4/2003
CN 1526938 A 9/2004
(Continued)

OTHER PUBLICATIONS

Protolabs.com; see Overmolding & Insert Molding _ Prototyping & Low-volume Production pdf from protolabs.com/services/injection-molding/overmolding-insert-molding/ (Year: 2021).*

*Primary Examiner* — Kenneth J Hansen
*Assistant Examiner* — David N Brandt
(74) *Attorney, Agent, or Firm* — Norman B. Thot

(57) ABSTRACT

A vapor pump for an automotive application includes a housing group with a pump housing having a pump chamber, an inlet opening and an outlet opening, and a motor housing having a motor chamber; a rotor shaft made from an electrically conductive material; a pumping wheel made of an electrically conductive plastic material arranged in the pump chamber and mounted on the rotor shaft to rotate therewith to pump the fuel vapor from the inlet opening to the outlet opening; a drive motor arranged in the motor chamber which includes a motor stator, a motor rotor and a motor control unit; a contact plug which electrically connects the motor control unit; and an electrically conductive bearing arrangement which is connected with the contact plug via a conductor. The motor rotor is connected with the rotor shaft to rotate therewith. The electrically conductive bearing arrangement rotatably supports the rotor shaft.

10 Claims, 3 Drawing Sheets

(51) Int. Cl.

| | |
|---|---|
| ***F04D 29/02*** | (2006.01) |
| ***F02D 41/00*** | (2006.01) |
| ***F02M 37/20*** | (2006.01) |
| ***F04D 7/02*** | (2006.01) |
| ***F04D 9/00*** | (2006.01) |
| ***F04D 13/06*** | (2006.01) |
| *F02M 25/08* | (2006.01) |
| *F04D 15/00* | (2006.01) |

(58) Field of Classification Search
CPC .. F04D 29/023; F04D 25/0693; F04D 29/053; F04D 9/001; F04D 13/06; F04D 7/02; F04D 13/0633; F04D 13/0606; F04D 15/0077; F04D 25/06; F04D 25/0606; F02D 41/0032; F02D 41/003
See application file for complete search history.

(56) References Cited

U.S. PATENT DOCUMENTS

| | | | | |
|---|---|---|---|---|
| 7,969,058 | B2 * | 6/2011 | Rahman | H02K 1/165 310/216.071 |
| 2004/0011129 | A1 | 1/2004 | Gilmour et al. | |
| 2004/0173013 | A1 | 9/2004 | Kobayashi et al. | |
| 2005/0263935 | A1 * | 12/2005 | Aisenbrey | F04B 49/10 264/115 |
| 2006/0024176 | A1 * | 2/2006 | Ikeya | F04D 13/06 417/366 |
| 2006/0219231 | A1 * | 10/2006 | Uchida | F01N 3/22 123/585 |
| 2009/0126699 | A1 | 5/2009 | Rumpf | |
| 2013/0119799 | A1 * | 5/2013 | Honda | F04D 5/002 310/71 |
| 2015/0285170 | A1 | 10/2015 | Nanba | |
| 2016/0248292 | A1 * | 8/2016 | Takarai | H05K 9/0015 |
| 2018/0135641 | A1 | 5/2018 | Nanba | |

FOREIGN PATENT DOCUMENTS

| | | | |
|---|---|---|---|
| CN | 202300928 | U | 7/2012 |
| CN | 105370551 | A | 3/2016 |
| DE | 198 43 022 | C1 | 3/2000 |
| DE | 103 24 800 | A1 | 1/2004 |
| EP | 2 060 773 | A2 | 5/2009 |
| FR | 2 613 431 | A1 | 10/1988 |
| JP | 63-154881 | A | 6/1998 |
| JP | 2013-104398 | A | 5/2013 |
| JP | 2016-223437 | A | 12/2016 |

* cited by examiner

MOTOR VEHICLE AUXILIARY POWER UNIT VACUUM PUMP

CROSS REFERENCE TO PRIOR APPLICATIONS

This application is a U.S. National Phase application under 35 U.S.C. § 371 of International Application No. PCT/EP2016/069326, filed on Aug. 15, 2016. The International Application was published in English on Feb. 22, 2018 as WO 2018/033194 A1 under PCT Article 21(2).

FIELD

The present invention relates to a vapor pump for automotive applications, in particular to a purge pump for venting a fuel vapor accumulator, comprising a housing group including at least a pump housing with a pump chamber and a motor housing with a motor chamber, wherein the pump housing has an inlet opening and an outlet opening, wherein a pumping wheel is provided in the pump chamber for pumping fuel vapor from the inlet opening to the outlet opening, wherein the pump wheel is mounted on a rotor shaft for rotation therewith, wherein a drive motor with a motor stator, a motor rotor and a motor control unit is provided in the motor chamber, and wherein the motor rotor is connected with the rotor shaft for rotation therewith.

BACKGROUND

In an automotive application, an electric vapor pump is used, among others, as a part of an automotive vapor pump arrangement for pumping gas comprising fuel vapor from a vapor absorption unit to a vapor target, for example, to the intake section of an internal combustion engine. An example of a typical automotive fuel vapor pump arrangement is described in US 2015/0285170 A1. A typical purge pump is also described therein.

A disadvantage of these pumps is the electrostatic charging of the pumping wheel, the accompanying danger of sparking, and the danger of the fuel vapor being ignited. The water proportion in the fuel vapor may also cause substantial corrosion damages to the vapor pump.

SUMMARY

An aspect of the present invention to provide a vapor pump which avoids the above disadvantages in a simple and economic manner.

In an embodiment, the present invention provides a vapor pump for an automotive application. The vapor pump includes a housing group comprising a pump housing which comprises a pump chamber, an inlet opening and an outlet opening, and a motor housing which comprises a motor chamber; a rotor shaft made from an electrically conductive material; a pumping wheel arranged in the pump chamber and mounted on the rotor shaft so as to rotate therewith; a drive motor comprising a motor stator, a motor rotor and a motor control unit; a contact plug configured to provide an electric connection of the motor control unit; a conductor; and an electrically conductive bearing arrangement which is directly or indirectly electrically connected with the contact plug via the conductor. The pumping wheel is configured to pump the fuel vapor from the inlet opening to the outlet opening. The pumping wheel is made at least in part from an electrically conductive plastic material. The drive motor is arranged in the motor chamber. The motor rotor is connected with the rotor shaft so as to rotate therewith. The electrically conductive bearing arrangement is configured to rotatably support the rotor shaft.

BRIEF DESCRIPTION OF THE DRAWINGS

The present invention is described in greater detail below on the basis of embodiments and of the drawings in which.

DETAILED DESCRIPTION

Figure 1:
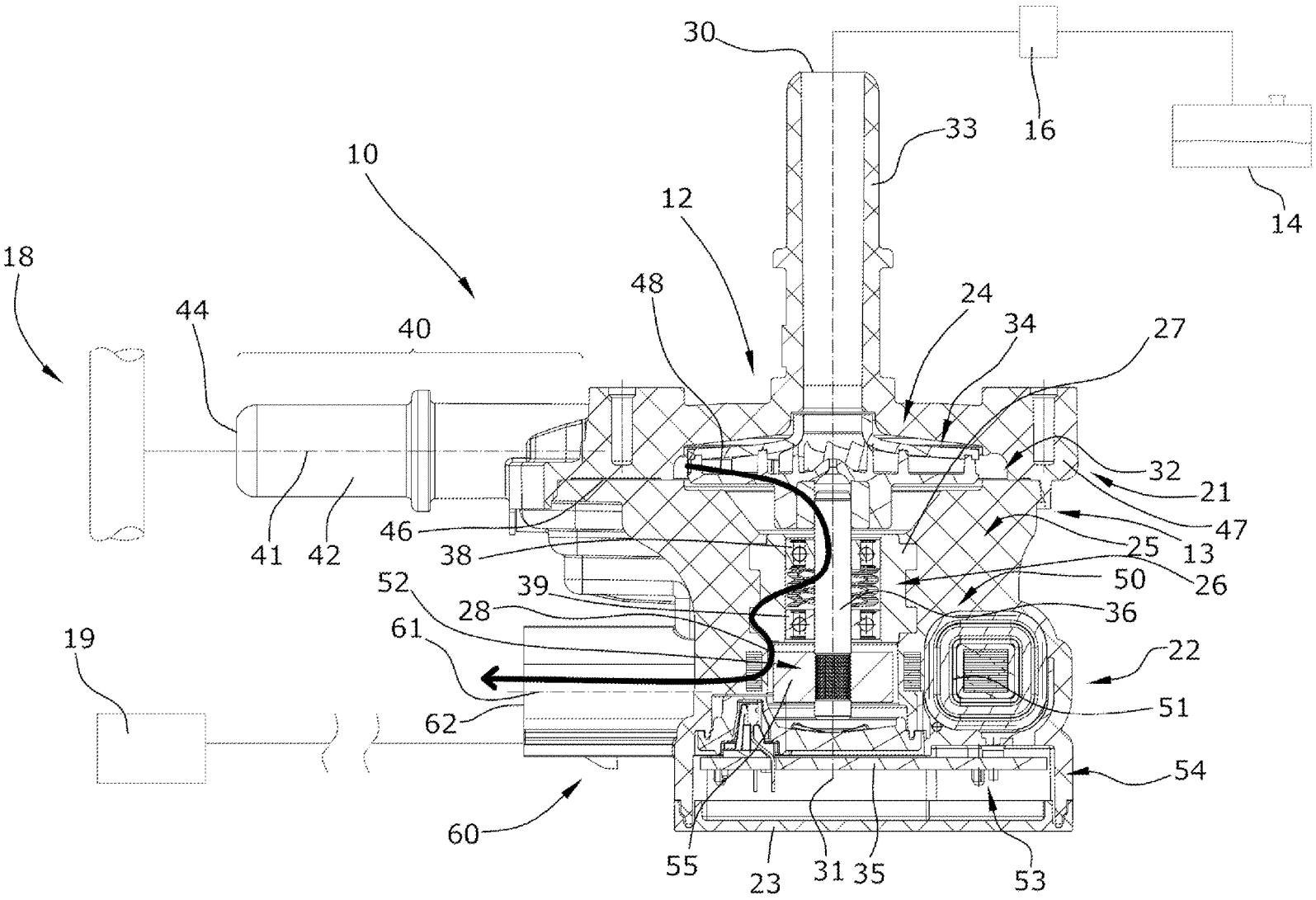
FIG. 1 shows an automotive vapor pump arrangement comprising a vapor pump in longitudinal cross section.

In an embodiment, the present invention provides a pumping wheel which is at least in part from an electrically conductive plastic material and a rotor shaft which is from an electrically conductive material, wherein the rotor shaft is rotatably supported in an electrically conductive bearing arrangement which is electrically connected either indirectly or directly with the contact plug via a conductor and is thereby grounded. An ignition of the fuel vapor is thereby prevented in a simple and economic manner. Corrosion damage to the pumping wheel is also prevented.

In an embodiment of the present invention, the pumping wheel can, for example, include electrically conductive fillers such as graphite. Intrinsically conductive polymers may also be used to manufacture the pumping wheel.

It is advantageous if the rotor shaft is made of metal to provide a simple and economic electric connection from the pumping wheel to the contact plug.

In an embodiment of the present invention, the motor housing can, for example, be a solid plastic housing with a motor stator potted therein. The motor stator and, possibly, electronic components are thereby completely sealed off from the pump chamber. It is thus possible to exclude corrosion damage to metal components caused by fuel vapor. It is of course also possible to provide a can which is known per se. It is thereby particularly advantageous if the pump chamber of the pump housing is enclosed by a pump housing part and an end face of the plastic housing.

In an embodiment of the present invention, the drive motor can, for example, be a permanently excited motor, the motor rotor comprising permanent magnets which are overmolded with a plastic material. A very effective protection against corrosion is thereby provided. It is thereby particularly advantageous if the drive motor is an asymmetrically permanently excited drive motor. This allows for a very compact motor housing. The manufacture of the molded pump housing is considerably simplified due to the fact that the motor stator is only provided on one side of the motor rotor.

In an embodiment of the present invention, the pumping wheel can, for example, be designed as a centrifugal wheel. The centrifugal wheel can, for example, be formed by a vane portion of plastic material and a pot portion connected therewith, the centrifugal wheel being fixedly mounted to the rotor shaft via the pot portion.

In an embodiment of the present invention, the conductor can, for example, be formed by a conductive wire connection with the contact plug, or, as an alternative, the conductive wire connection is guided via a circuit board of the motor control unit in order to avoid electric charging of the pumping wheel.

An embodiment of the present invention is described below under reference to the drawing.

The Figure schematically shows an automotive vapor pump arrangement 10 with a vapor pump 12 for pumping a pump gas comprising fuel vapor. The automotive vapor pump arrangement 10 comprises an automotive fuel tank 14 which is fluidically connected to a vapor absorption unit 16 (fuel vapor accumulator). The vapor absorption unit 16 can comprise charcoal. The vapor absorption unit 16 is fluidically connected with a pump inlet 30 of the vapor pump 12. A pump outlet 44 of the vapor pump 12 is fluidically connected to a vapor target 18 which is an intake section of an internal combustion engine (not shown in the Figure). The vapor pump 12 is also known as a so-called purge pump.

The vapor pump 12 is designed as a flow pump comprising a housing arrangement 13 which comprises two separate housing parts, namely, a pumping housing 21 defining a pump chamber 24 and having the pump inlet 30 and the pump outlet duct 40, and a separate motor housing part 22 defining a motor chamber 25 and comprising an electric motor 50, a bearing arrangement 26 with a steel bush 27, and two roller bearings 38, 39, an electric connector plug 60, and an impeller-like pumping wheel 34 which is configured as centrifugal wheel with an axial gas inlet. The rotating pumping wheel 34 rotates with a high rotational speed of between 10000 to 45000 rpm. The pump gas is thereby accelerated and radially flows into an outlet volute 32 from where the pump gas flows into a tangential pump outlet duct 40 with the pump outlet 44 at its distal end. The pressure rise caused by the rotating pumping wheel 34 is in the range of 50 to 100 mbar.

The rotor assembly comprises the pumping wheel 34 supported by a rotor shaft 36 which is rotatably supported by the two roller bearings 38, 39 at the motor housing part 22. The rotor shaft 36 also is provided with a permanently magnetized motor rotor 52 which is surrounded by a motor stator 51, whereby the motor 50 is provided as a so-called asymmetrical motor. The rotor assembly rotates around a rotation axis 31, whereby permanent magnets 55 of the motor rotor 52 are plastic molded.

The motor housing part 22 also defines a motor electronics chamber 54 which comprises a motor control unit 53 for driving the motor rotor 52. The motor electronics chamber 54 is closed by a separate electronics chamber cover 23.

The pumping housing 21 defines an axial inlet duct 33, which is axially aligned with the pumping wheel 34 and the rotation axis, and a tangential pump outlet duct 40 which is defined by a tube-like and straight outlet duct wall 42. The pump outlet duct 40 defines a general outlet duct axis 41.

The motor housing part 22 defines an electric connector plug 60 with a couple of contact pins 62. The electric connector plug 60 has a general plugging axis 61 which is the general direction for connecting or disconnecting a corresponding plug with/from to the electric connector plug 60. The electric connector plug 60 is electrically connected to an external control unit 19 for controlling the vapor pump 12.

Figure 2:
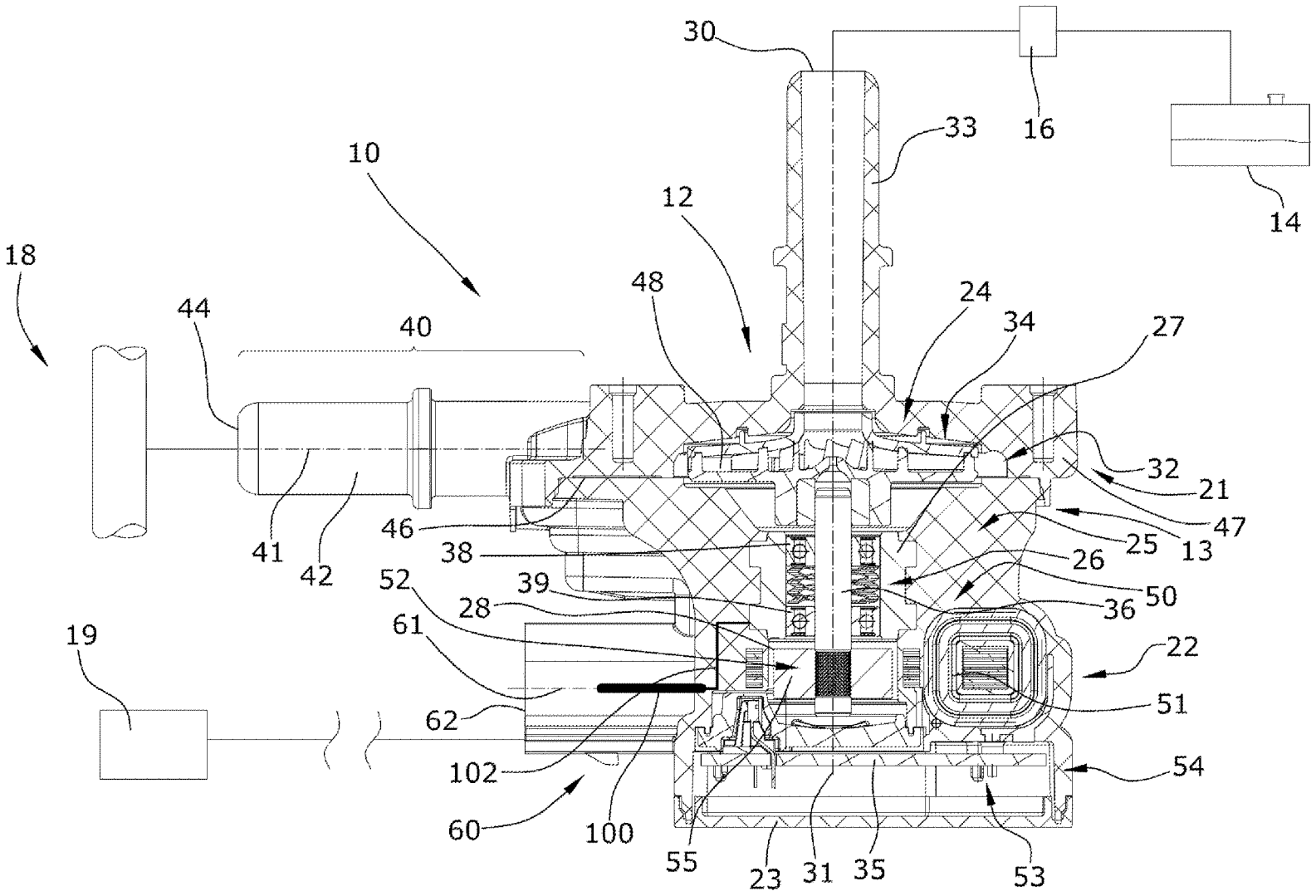
FIG. 2 shows the steel bush of the bearing arrangement being electrically connected with the electric contact plug via a conductor which is designed as an electric wire connection so as to effect a connection to ground.
Figure 3:
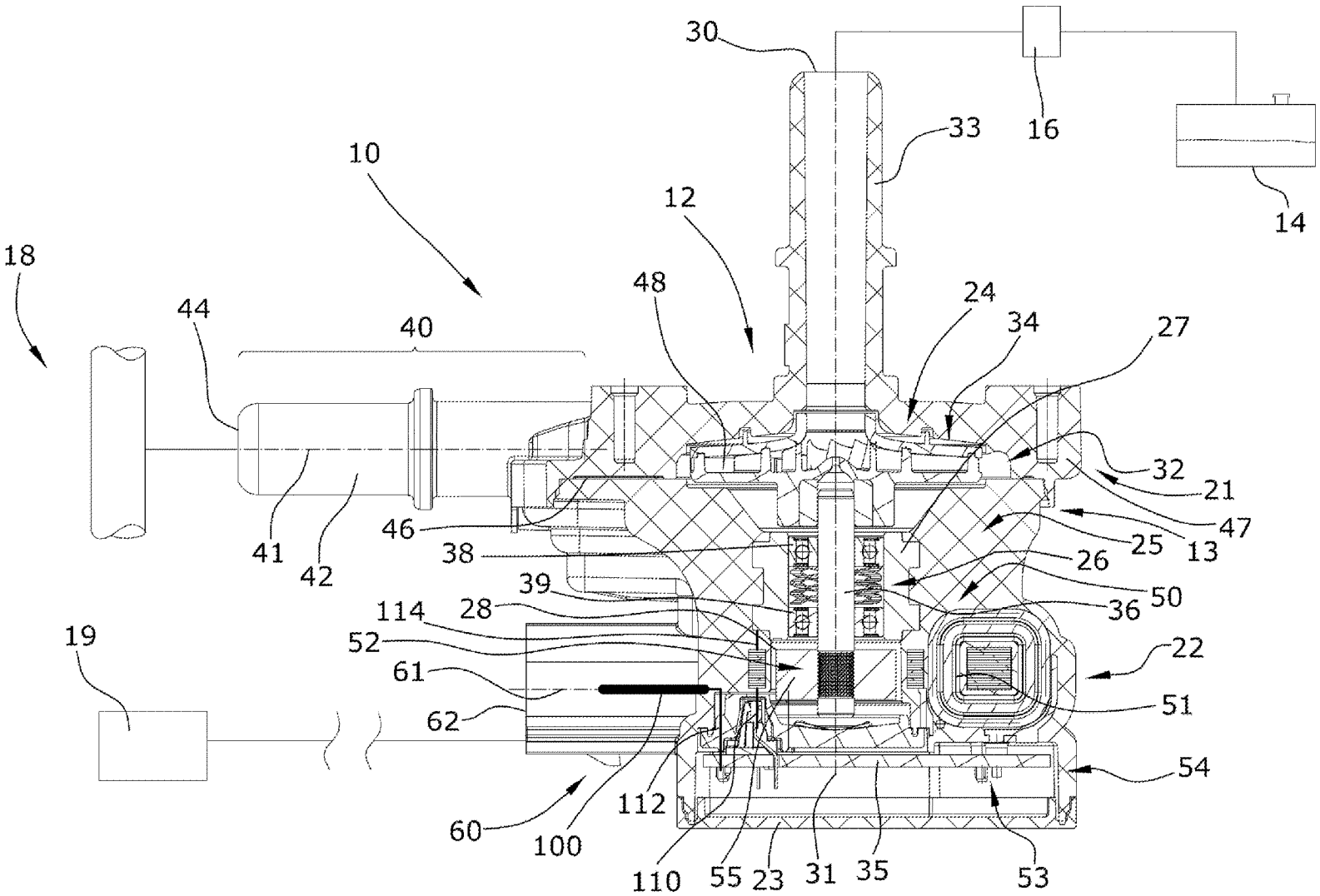
FIG. 3 shows the steel bush of the bearing arrangement being electrically connected with the electric contact plug via a conductor which is designed as an electric wire connection via a circuit board so as to effect a connection to ground.

To provide that an electrostatic charging of the pumping wheel does not cause an ignition of the fuel vapor, the present invention provides that the pumping wheel 34 is made at least in part from an electrically conductive plastic material and the rotor shaft 36 is made from an electrically conductive material. The rotor shaft 36 is rotatably supported in an electrically conductive bearing arrangement 26. In the present embodiment, the bearing arrangement 26, and thus the steel bush 27, are electrically connected with the electric contact plug 60 via a conductor 28 which, as shown in FIG. 2, is designed as an electric wire connection 102, so as to effect a connection to ground 100. As shown in FIG. 3, it is, however, also conceivable to guide the conductive wire connection 110, 112, 114 via a circuit board 35 which, in a manner known per se, is a part of the motor control unit 53, so as to effect a connection to ground 100. An electrical path from the pumping wheel 34 to the contact pins 62 of the electric connector plug 60 is indicated by the reference sign 48.

The pumping wheel 34 in the present embodiment includes fillers of graphite in order to achieve electric conductivity. In the present embodiment, the motor housing part 22, and thus a motor chamber 25 enclosed thereby, is formed substantially as a solid plastic material housing 22 in which the motor stator 51 is potted. Together with a pump housing part 47, an end face 46 of this solid plastic material housing 22, directed to the pumping wheel 34, encloses a pump chamber 24 in which, substantially, the pumping wheel is supported on the metal rotor shaft 36 for rotation therewith. On the side of the plastic material housing opposite the end face, the circuit board 35 is provided which is closed by a cover 23. This embodiment provides protection against corrosion damages in a simple and economic manner.

The present invention is not limited to embodiments described herein; reference should be had to the appended claims.

What is claimed is:

1. A vapor pump for an automotive application, the vapor pump comprising:

a housing group comprising, a pump housing which comprises a pump chamber, an inlet opening and an outlet opening, and a motor housing which comprises a motor chamber;

a rotor shaft made from an electrically conductive material;

a pumping wheel arranged in the pump chamber and mounted on the rotor shaft so as to rotate therewith, the pumping wheel being configured to pump fuel vapor from the inlet opening to the outlet opening, the pumping wheel being made at least in part from an electrically conductive plastic material;

a drive motor comprising a motor stator, a motor rotor and a motor control unit, the drive motor being arranged in the motor chamber, the motor rotor being connected with the rotor shaft so as to rotate therewith;

a contact plug configured to provide an electric connection of the motor control unit;

a conductor; and an electrically conductive bearing arrangement which is directly or indirectly electrically connected with the contact plug via the conductor, the electrically conductive bearing arrangement being configured to rotatably support the rotor shaft wherein, the motor housing is provided as a solid plastic material housing which overmolds the motor stator, the conductor is formed at least by a conductive wire connection to the contact plug, and an electrical path to ground is provided from the pumping wheel via the electrically conductive bearing arrangement and the conductor to the contact plug.

2. A method of using the vapor pump as recited in claim 1, the method comprising: providing, the vapor pump; and using the vapor pump as a purge pump for venting a fuel vapor accumulator.

3. The vapor pump as recited in claim 1, wherein the electrically conductive plastic material of the pumping wheel comprises an electrically conductive filler.

4. The vapor pump as recited in claim 3, wherein the electrically conductive filler is graphite.

5. The vapor pump as recited in claim 1, wherein the electrically conductive material of the rotor shaft is a metal.

6. The vapor pump as recited in claim 1, wherein, the pump housing further comprises: a pump housing part, the motor housing comprises an end face, and the pump chamber of the pump housing is enclosed by the pump housing part and the end face.

7. The vapor pump as recited in claim 1, wherein, the drive motor is a permanently excited drive motor, and the motor rotor comprises permanent magnets potted in a plastic material.

8. The vapor pump as recited in claim 1, wherein the drive motor is an asymmetrically permanently excited drive motor.

9. The vapor pump as recited in claim 1, wherein the pumping wheel is a centrifugal wheel.

10. The vapor pump as recited in claim 1, wherein, the motor control unit comprises a circuit board, and the conductive wire connection is guided via the circuit board of the motor control unit.

* * * * *